US011732716B2

(12) United States Patent
Tetu

(10) Patent No.: US 11,732,716 B2
(45) **Date of Patent: *Aug. 22, 2023**

(54) MODULAR COMPRESSOR DISCHARGE SYSTEM

(71) Applicant: Carrier Corporation, Palm Beach Gardens, FL (US)

(72) Inventor: Lee G. Tetu, Baldwinsville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 181 days.

This patent is subject to a terminal disclaimer.

(21) Appl. No.: 17/253,826

(22) PCT Filed: Dec. 6, 2019

(86) PCT No.: PCT/US2019/064835

§ 371 (c)(1),
(2) Date: Dec. 18, 2020

(87) PCT Pub. No.: WO2020/123273

PCT Pub. Date: Jun. 18, 2020

(65) Prior Publication Data

US 2021/0115926 A1 Apr. 22, 2021

Related U.S. Application Data

(60) Provisional application No. 62/777,379, filed on Dec. 10, 2018.

(51) Int. Cl.

| | |
|---|---|
| ***F04C 29/06*** | (2006.01) |
| ***F04C 18/16*** | (2006.01) |
| ***F04C 29/02*** | (2006.01) |

(52) U.S. Cl.
CPC ..... *F04C 29/065* (2013.01); *F04C 18/16* (2013.01); *F04C 29/026* (2013.01); *F04C 29/061* (2013.01)

(58) Field of Classification Search
CPC .... F04B 39/0061; F04C 18/16; F04C 29/026; F04C 29/061; F04C 29/065
See application file for complete search history.

(56) References Cited

U.S. PATENT DOCUMENTS

| | | |
|---|---|---|
| 5,208,429 A | 5/1993 | Field |
| 5,246,357 A | 9/1993 | Sjoholm et al. |

(Continued)

FOREIGN PATENT DOCUMENTS

| | | |
|---|---|---|
| CN | 103174652 B | 8/2015 |
| CN | 106704179 A | 5/2017 |

(Continued)

OTHER PUBLICATIONS

International Preliminary Report on Patentablility for International Application No. PCT/US2019/064835 dated Jun. 24, 2021.

(Continued)

*Primary Examiner* — Mary Davis
(74) *Attorney, Agent, or Firm* — Carlson, Gaskey & Olds, P.C.

(57) ABSTRACT

A method of assembling a compressor system includes attaching at least two pulsation damper stages to a discharge port on a compressor, and attaching additional pulsation dampening stages if additional stages are desired. A compressor and discharge system is also disclosed.

8 Claims, 6 Drawing Sheets

(56) References Cited

U.S. PATENT DOCUMENTS

| | | | | |
|---|---|---|---|---|
| 7,100,737 | B2 | 9/2006 | Sishtla | |
| 7,993,112 | B2 | 8/2011 | Rockwell | |
| 8,016,071 | B1 | 9/2011 | Martinus et al. | |
| 8,156,757 | B2 | 4/2012 | Doty et al. | |
| 9,657,732 | B2 | 5/2017 | Lucas et al. | |
| 2002/0027041 | A1 | 3/2002 | Czabala et al. | |
| 2010/0310389 | A1* | 12/2010 | Alvarenga | F04B 39/0061 417/312 |
| 2014/0017110 | A1 | 1/2014 | Zemliak | |
| 2014/0023542 | A1 | 1/2014 | Yamashita et al. | |
| 2016/0312778 | A1 | 10/2016 | Zaytsev | |
| 2018/0258936 | A1 | 9/2018 | Reba et al. | |
| 2021/0199114 | A1* | 7/2021 | Reba | F04C 29/06 |

FOREIGN PATENT DOCUMENTS

| | | | |
|---|---|---|---|
| CN | 207122426 | U | 3/2018 |
| CN | 105065275 | B | 4/2018 |
| JP | H05-133377 | A | 5/1993 |
| JP | 2000-018184 | A | 1/2000 |
| KR | 2003-0034807 | A | 5/2003 |

OTHER PUBLICATIONS

International Search Report and Written Opinion for International Application No. PCT/US2019/064835 dated Feb. 12, 2020.
Kaeser Compressors®. Rotary Screw Compressors, SX-HSD Series. pp. 1-36. www.kaeser.com.

* cited by examiner

MODULAR COMPRESSOR DISCHARGE SYSTEM

CROSS-REFERENCE TO RELATED APPLICATION

This application claims priority to U.S. Provisional Patent Application No. 62/777,379 filed on Dec. 10, 2018.

BACKGROUND

This application relates to a modular system for easily creating a specifically tailored discharge system downstream of a compressor.

Modern compressors are known and are utilized to compress various fluids. One common example is a refrigerant compressor. A refrigerant compressor faces numerous challenges. For one, the sound emanating from the compressor must be controlled and limited. One source of source of sound is pulsations, and thus it is known to provide pulsation dampening systems. In addition, mufflers, oil separators, and discharge valves are also commonly incorporated.

In some applications, more pulsation dampening may be required, a muffler may or may not be required, and an oil separator may or may not be required. Currently, a number of distinct housings must be provided to specifically tailor what is to be included with the compressor in its intended application.

SUMMARY

In a featured embodiment, a method of assembling a compressor system includes attaching at least two pulsation damper stages to a discharge port on a compressor, and attaching additional pulsation dampening stages if additional stages are desired.

In another embodiment according to the previous embodiment, each of the stages are generally identical having an inlet spaced from an outlet by 180° about a center line of the stage.

In another embodiment according to any of the previous embodiments, at least one of a muffler and an oil separator is added.

In another embodiment according to any of the previous embodiments, a component discharge including a check valve is mounted downstream of a downstream most of the pulsation dampening stage.

In another embodiment according to any of the previous embodiments, the pulsation dampening stage includes a plurality of cells extending into a housing member. A bottom wall and an open outer wall communicate with the flow passage. A plurality of orifices extend into each of the cells, with the orifices having a smaller diameter than a hydraulic diameter of the cells.

In another embodiment according to any of the previous embodiments, the orifices are formed in a perforated plate that encloses the plurality of cells.

In another embodiment according to any of the previous embodiments, the compressor is a screw compressor.

In another embodiment according to any of the previous embodiments, an average depth into the cells is measured between an inner face of the perforated plate and the bottom wall of the cell is defined as a first distance. A second distance is defined as an average hydraulic diameter of the cells and a ratio of the first distance to the second distance is between 0.025 and 25.

In another embodiment according to any of the previous embodiments, a diameter of the orifices is defined as a third distance and a ratio of the first distance to the third distance is between 0.5 and 500.

In another embodiment according to any of the previous embodiments, a dual stage pulsation dampener is included having an inlet and an outlet that are circumferentially aligned.

In another embodiment according to any of the previous embodiments, at least one of a muffler and an oil separator is added.

In another embodiment according to any of the previous embodiments, a component discharge including a check valve is mounted downstream of a downstream most of the pulsation dampening stage.

In another embodiment according to any of the previous embodiments, the pulsation dampening stage includes a plurality of cells extending into a housing member. A bottom wall and an open outer wall communicate with the flow passage. A plurality of orifices extend into each of the cells, with the orifices having a smaller diameter than a hydraulic diameter of the cells.

In another embodiment according to any of the previous embodiments, the orifices are formed in a perforated plate that encloses the plurality of cells.

In another embodiment according to any of the previous embodiments, an average depth into the cells is measured between an inner face of the perforated plate and the bottom wall of the cell is defined as a first distance. A second distance is defined as an average hydraulic diameter of the cells and a ratio of the first distance to the second distance is between 0.025 and 25.

In another embodiment according to any of the previous embodiments, a diameter of the orifices is defined as a third distance and a ratio of the first distance to the third distance is between 0.5 and 500.

In another featured embodiment, a compressor and discharge system includes a compressor housing having an outlet port and a discharge system attached to the outlet port. The discharge system includes at least a plurality of pulsation dampening stages. The pulsation dampening stages are generally identical and each have an inlet spaced from an outlet by 180 degrees about a center line of the stage.

In another embodiment according to the previous embodiment, there is also at least a dual stage pulsation dampener mounted within a housing including an inlet and an outlet that are circumferentially aligned.

In another embodiment according to any of the previous embodiments, the pulsation dampening stages includes a plurality of cells extending into a housing member. A bottom wall and an open outer wall communicate with the flow passage. A plurality of orifices extend into each of the cells, with the orifices having a smaller diameter than a hydraulic diameter of the cells.

In another embodiment according to any of the previous embodiments, at least one of a muffler and an oil separator is downstream of the plurality of pulsation dampening systems.

These and other features may be best understood from the following drawings and specification.

DETAILED DESCRIPTION

Figure 1A:
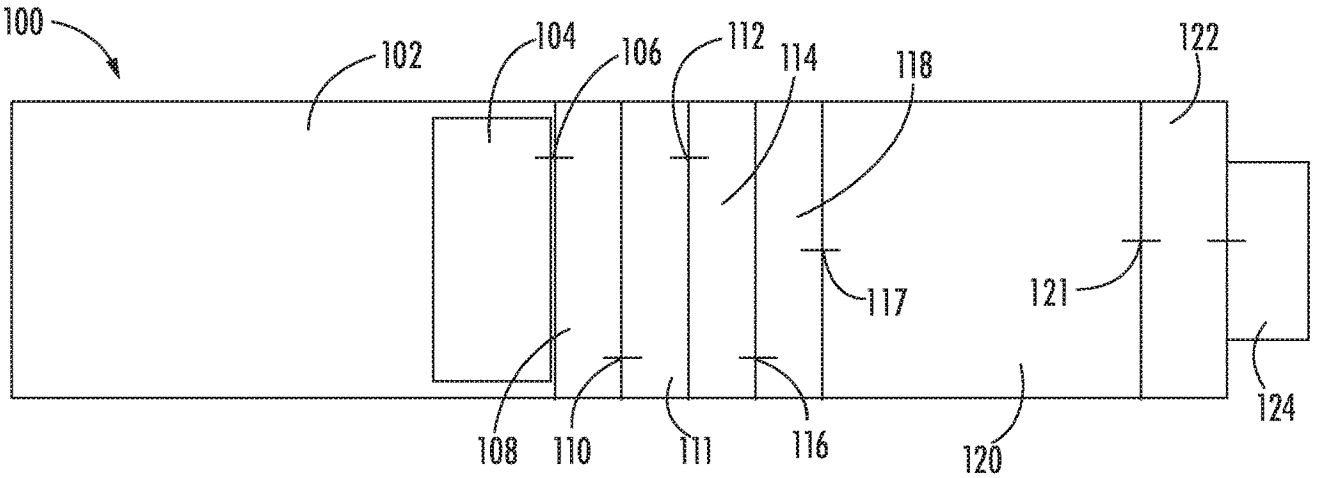
FIG. 1A shows a first assembled system.

FIG. 1A shows a compressor and discharge system 100 which may be incorporated into a refrigerant cycle. A compressor 102 is shown having a discharge 104. The compressor 102 may be a screw compressor. As known, screw compressors raise challenges with regard to addressing pulsations. While a screw compressor is specifically mentioned, the teachings of this disclosure would extend to other type compressors.

A discharge system has been individually tailored for the compressor assembly 100. Thus, three pulsation dampening stages 108, 111, and 114 are mounted in series. As shown, an inlet 106 to the first stage 108 is associated with the discharge of the compressor 102. A discharge 110 of the stage 108 is aligned with an inlet to the second stage 111. Similarly, a discharge 112 from the stage 111 is circumferentially aligned with the inlet to a third stage 114. A discharge 116 of the third stage 114 is aligned with an inlet to a muffler 118.

As can be seen, the inlets and outlets of the stages 108/111/114 may be generally circumferentially spaced by 180°. The three pulsation dampeners 108/111/114 can be generally identical.

A designer of the compressor system 100 may choose to add more or fewer pulsation dampening units.

The muffler 118 has an outlet 117 communicating into an oil separator 120. The oil separator 120 has an outlet 121 communicating through a component discharge 122, and then to a discharge flange 124. The component discharge 122 may include a check valve.

Figure 1B:
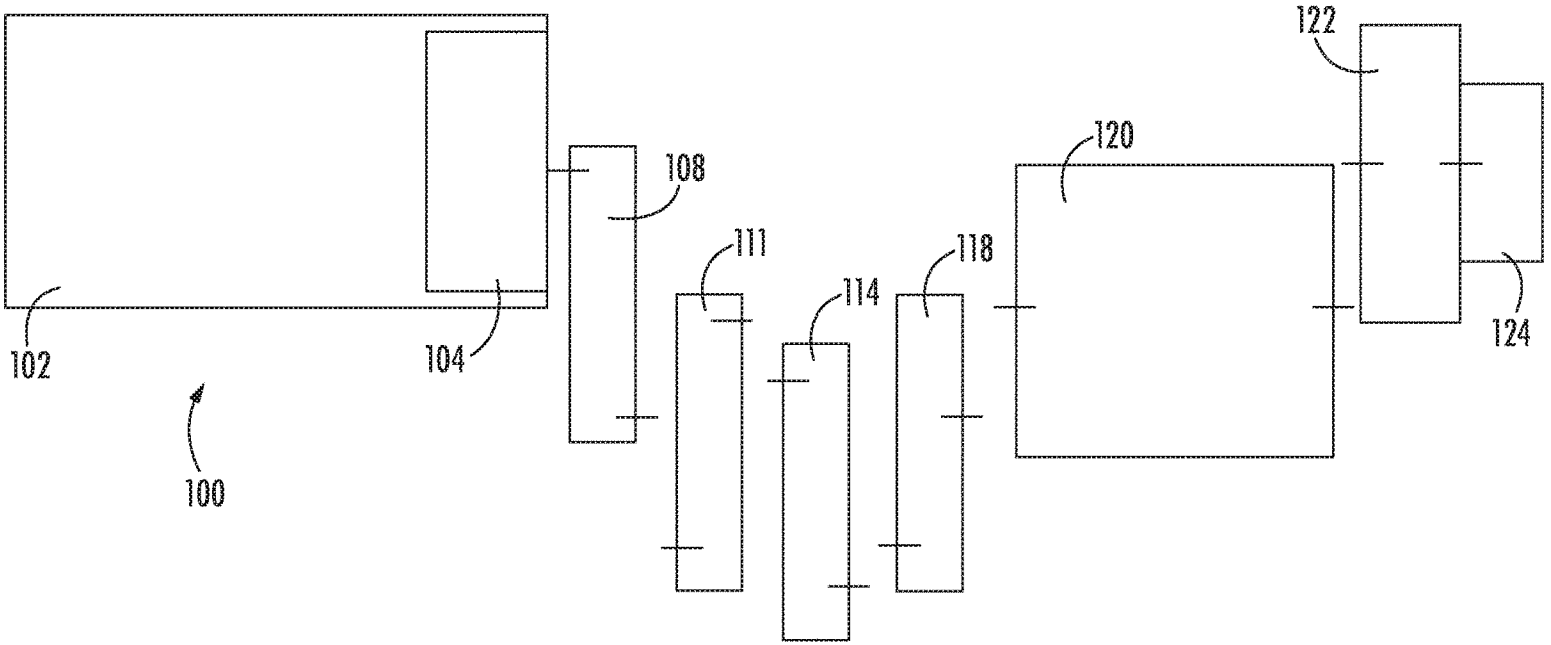
FIG. 1B shows the first assembled system in an exploded view.

FIG. 1B is an exploded view of the assembly 100. As shown, the stages 108/111/114 are generally identical.

Figure 2A:
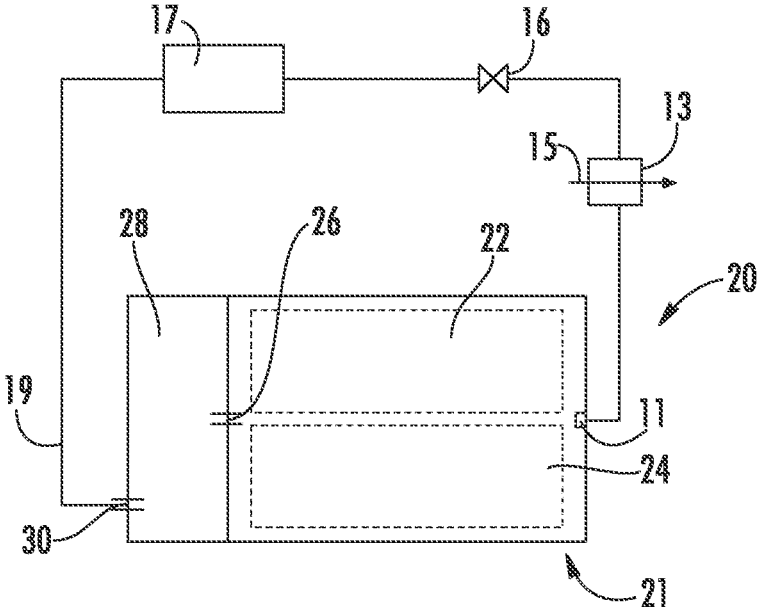
FIG. 2A schematically shows a refrigerant cycle.

FIG. 2A shows a refrigerant cycle 20 having a compressor 21 with two intermeshed screw rotors 22 and 24. A worker of skill in this art recognizes that refrigerant can enter the compressor through an inlet 11, be compressed by the rotors 22 and 24, and leave the compressor 21 through a discharge outlet 26. A discharge system 28 (which may be as disclosed above, or below) is shown downstream of the discharge 26 and has an exit port 30 leaving a housing.

Downstream of the exit 30, a flow line 19 communicates the refrigerant to a condenser 17, an expansion valve 16, and to an evaporator 13. A fluid to be cooled is shown at 15 and may be air or water which may be utilized to cool another location. Downstream of the evaporator 13 refrigerant returns to the inlet 11.

As mentioned above, in particular with regard to screw compressors, there are pulsations in the flow leaving the discharge port 26 and the exit port 30. The discharge system 28 is thus intended to minimize these pulsations.

Figure 2B:
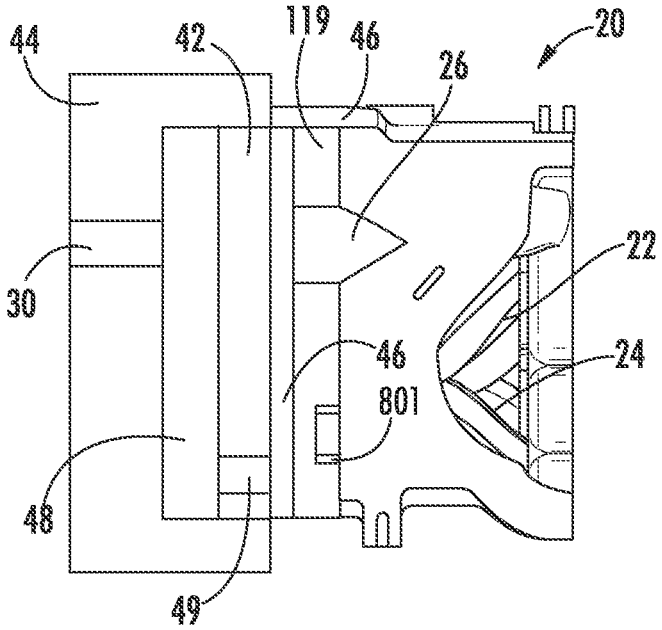
FIG. 2B shows a detail of a compressor and a pulsation dampening housing.

FIG. 2B shows an embodiment. As shown, the refrigerant leaving the discharge port 26 encounters a convoluted flow path. The exit 30 is spaced from the discharge 26 by a first resonator array 46, a non-resonator containing flow passage 49, and a second resonator array location 48. As will be explained below, the resonator arrays 46 and 48 are formed in part by cavities or cells formed in a stage divider 42, which also forms at least a portion of the non-resonator containing flow passage 49. There are also cells formed in a bearing cover 119 on an opposed side of the cells in the stage divider 42 to form resonator array 46. Bearing cover 119 is shown to house bearings 801 (shown schematically) for rotors 22/24. There are also cells within a cover plate 44 which also contains the exit port 30. These cells form a part of resonator array 48.

Figure 2C:
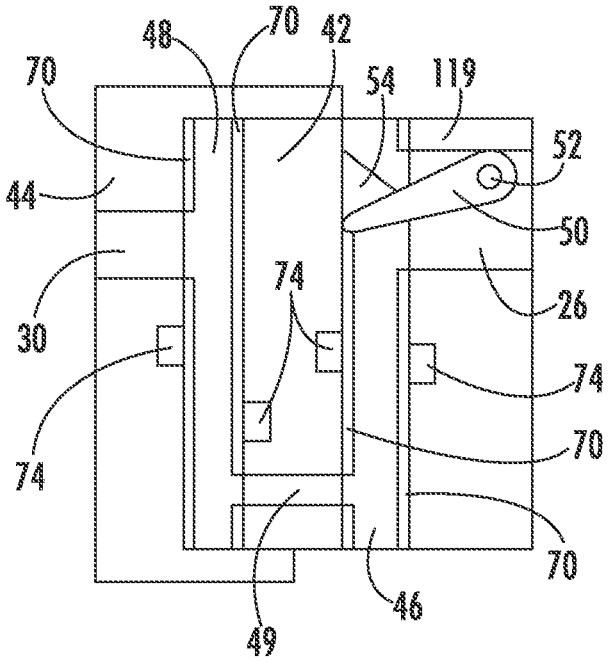
FIG. 2C shows a detail of the housing.

FIG. 2C shows details of the FIGS. 2A and 2B flow. A check valve 50 closes the discharge port 26 and pivots about a pivot pin 52 at shut down. A stop 54 is cast into the stage divider 42. A single cell 74 is shown in each location, but as will be explained below, there are plural cells at each location. Cover perforated plates 70 are shown and are perforated as will be explained in more detail below.

Passage 49 can be a non-circular flow path which improves the exposure area of the sound field with the sound absorbing cavities.

Figure 2D:
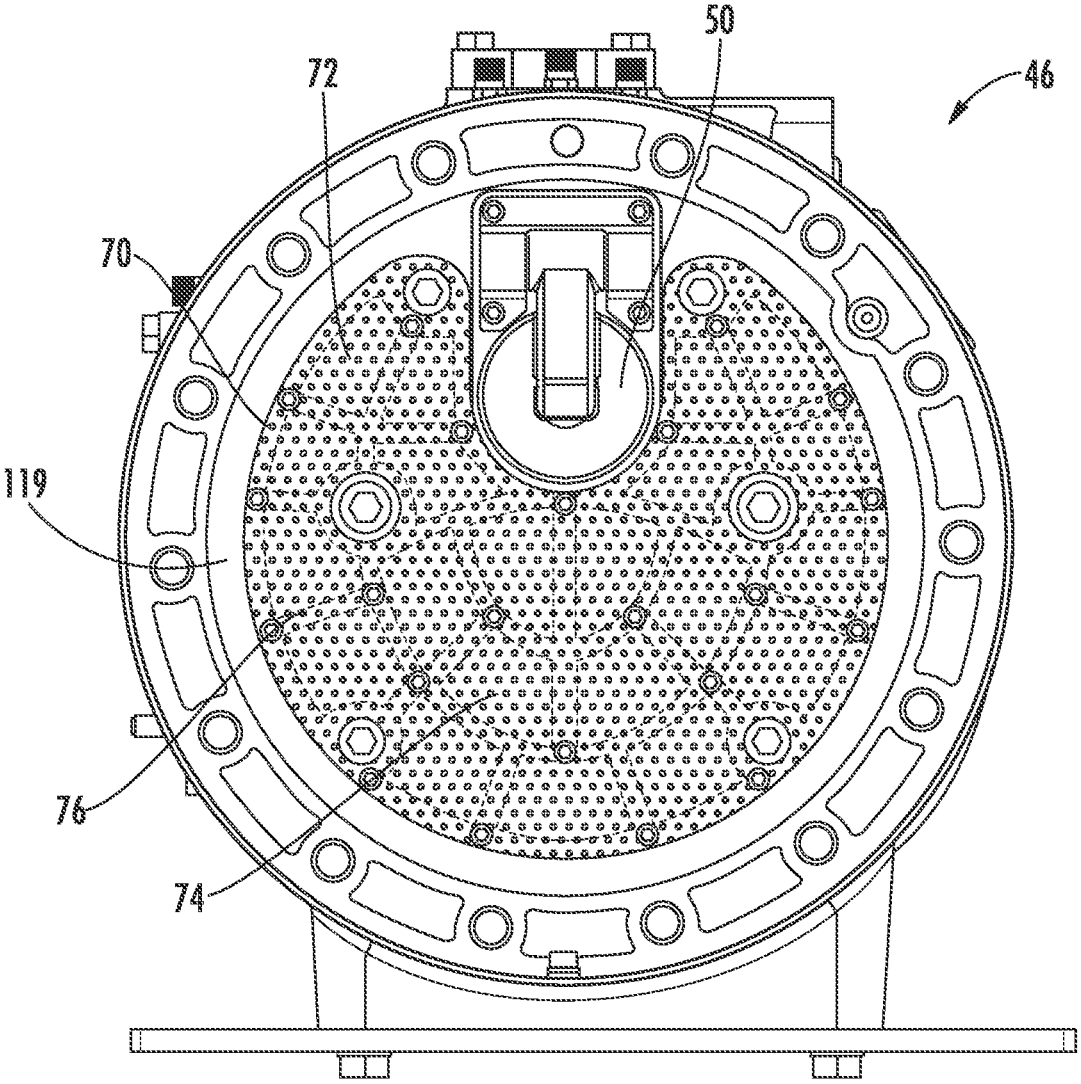
FIG. 2D shows a detail of chambers within the pulsation dampening housing.

FIG. 2D shows a detail of one side of the resonator array 46 and, in particular, that mounted in the bearing cover 119. As shown, the check valve 50 is surrounded by a resonator array including a plurality of cells 74 separated by walls 76. The plate 70 is formed with a plurality of perforations 72.

Figure 2E:
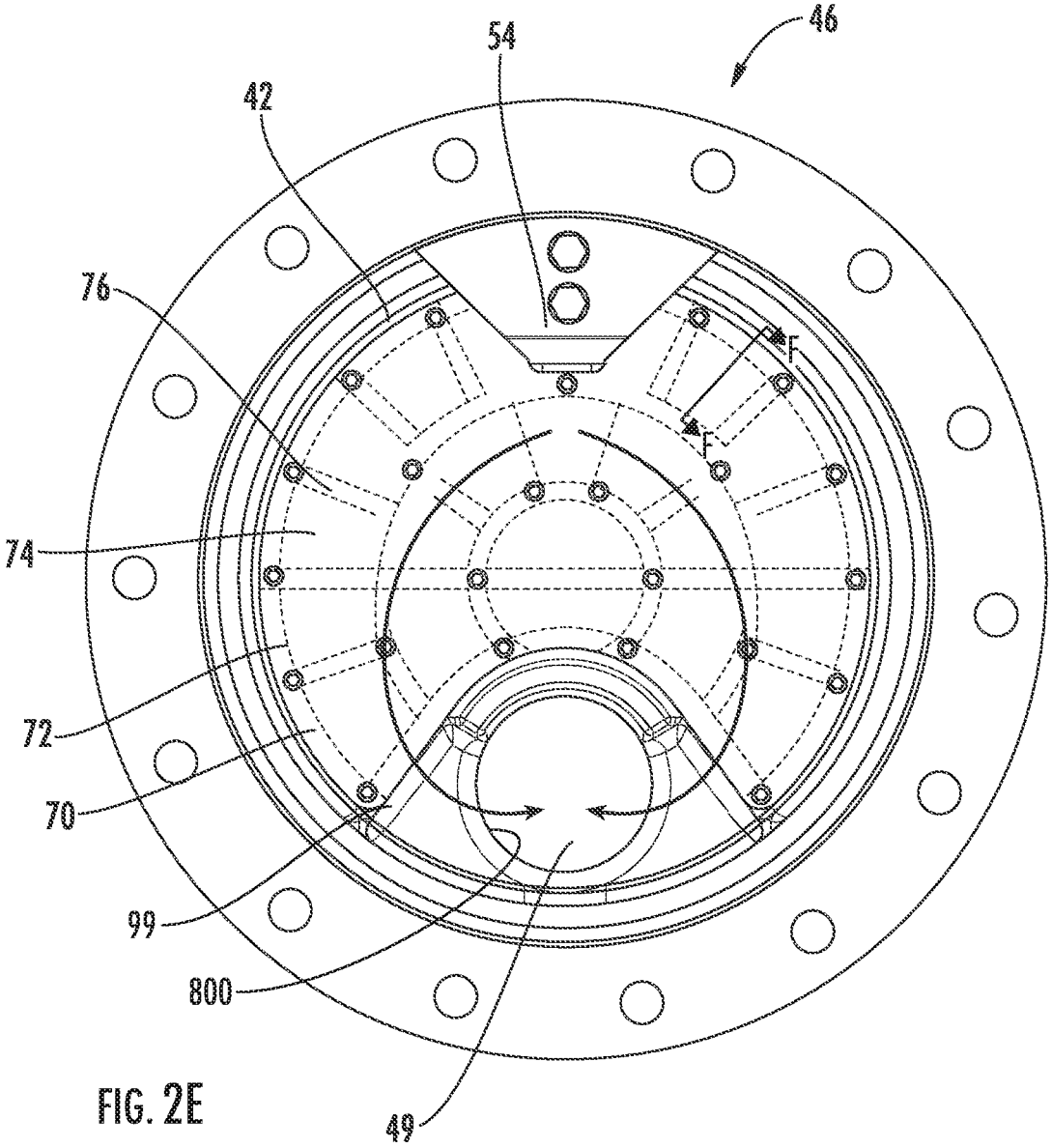
FIG. 2E shows further details in the pulsation dampening housing.

FIG. 2E shows the opposed side of resonator array 46. Again, in the opposed side of the resonator array 46 is the check valve stop 54 formed in the stage divider 42. In addition, there are cells 74 separated by wall 76. The perforated plate 70 has perforations or orifices 72. The flow passes around a flow divider 99 and then passes into connecting passageway 49 before reaching the second resonator array. This creates the non-circular cross-section (defined perpendicularly to a general flow direction between the arrays 46 and 48) as mentioned above. Note the cross-section need not be non-circular over its entire length as FIG. 2E has a cylindrical portion 800 near a downstream end.

Figure 2F:
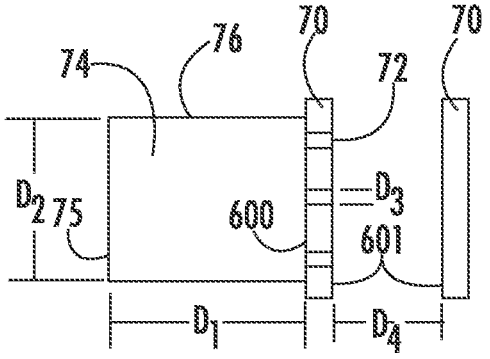
FIG. 2F schematically shows geometric relationships in the pulsation dampening system in a view generally along line F-F of FIG. 2E.

FIG. 2F shows a detail that is common to the resonator arrays on both sides of each stage. As shown, the cells 74 are separated by the walls 76. An inner or bottom wall 75 is illustrated. The plate 70 is shown covering an open outer wall of the cell 74 opposite bottom wall 75. As can be appreciated from this Figure, there are a plurality of orifices 72 associated with each cell 74. In embodiments, there may be 10 to 70 orifices per cell on average and in one example 50.

A first distance $d_1$ is defined between an inner surface 600 of the plate 70 and the wall 75. A second dimension $d_2$ is defined as an average hydraulic diameter for the cell 74. A third distance $d_3$ is defined as an average diameter of the orifices 72. A fourth dimension $d_4$ is defined as a distance between the outer faces 601 of opposed plates 70. In embodiments, a ratio of $d_1$ to $d_2$ is between 0.025 and 25. A ratio of $d_1$ to $d_3$ was between 0.5 and 500. A ratio of $d_1$ to $d_4$ was between 0.1 and 100.

In embodiments, the cover or perforated plate 70 has a characteristic thickness between the surfaces 600 and 601. The value $d_3$ can be related to this characteristic thickness, and may be 0.5 to 5.0 the characteristic thickness. The $d_3$ values can be 1.5 mm to 6.0 mm, and the characteristic thickness may be 1.0 to 10 mm and more narrowly 1.5 to 3.0 mm. The surface of the cover plate may be between 60 to 10 percent orifice space, compared to solid structure. The hydraulic diameter $d_2$ may be defined relative to a wavelength for sound frequencies of a particular concern. As an example, an exemplary hydraulic diameter could be 0.25 to 0.50 times the wavelength. Example hydraulic diameters, or $d_2$, can be between 10 mm and 50 mm. The depth $d_1$ can be between 2 mm and 50 mm, more narrowly 3 mm and 35 mm, and even more narrowly 5 and 25 mm.

The resonator arrays operate by cyclically moving the pulsations through the smaller orifices 72 into the enlarged cells 74, and then back out through the plurality of orifices associated with each cell. Such a resonator is more effective than typical muffler or pulsation dampening structure. As an example, this disclosure could be provided by adding less than one foot of axial length with the second stage resonator array.

While a perforated plate is shown, other ways of forming orifices may be used. The cells 74 may be cast into the several housing members.

Figure 3A:
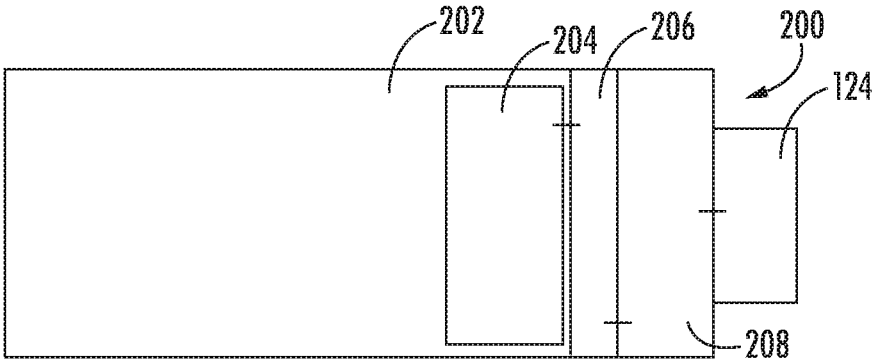
FIG. 3A shows an alternative arrangement.

FIG. 3A shows a simpler compressor system 200 wherein a compressor 202 has its discharge 204. A single stage pulsation damper 206 is selected which communicates directly with a component discharge 208 having a check valve.

Figure 3B:
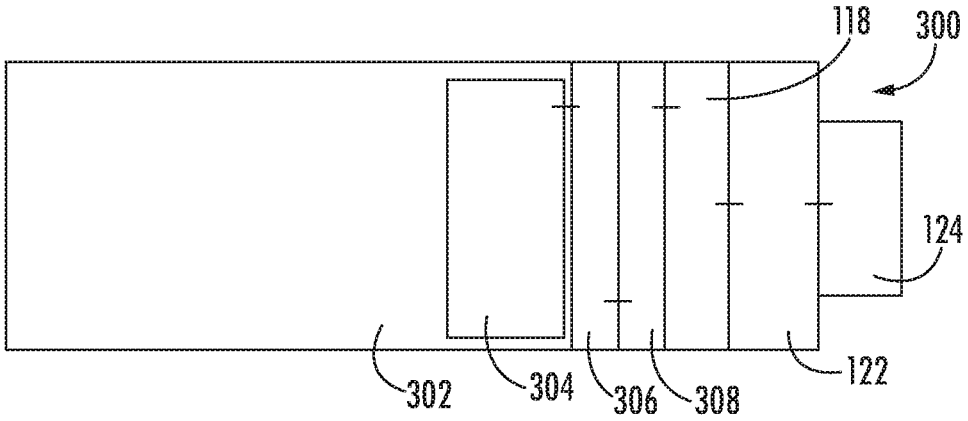
FIG. 3B shows another alternative arrangement.

FIG. 3B shows a system 300 wherein there are two pulsation dampening units 306 and 308 downstream of a compressor 302 having a discharge 304. A muffler 118 is utilized, as is a component discharge 122, having a check valve and a discharge flange 124.

As can be appreciated, a designer of compressor systems may now select various components and attach those components in a manner that does not require unique housings to be formed for each particular application. The worker of ordinary skill in this art would recognize that some simplified universal attachment method would also be included. As one example only, bolts can extend through bolt holes in a housing associated with each of the assembled components. A length of the selected bolts can be varied dependent on the number of components to be assembled into the particular compressor system.

Figure 4:
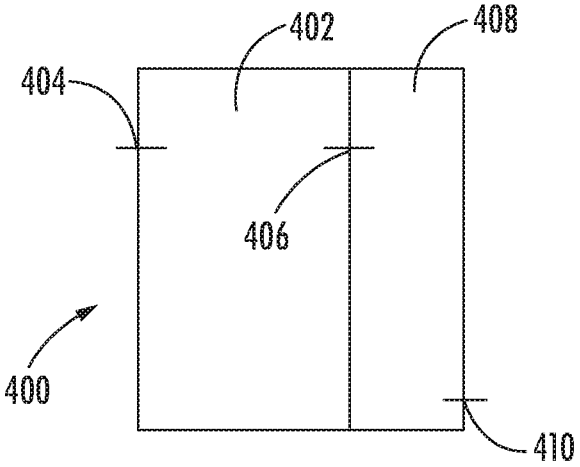
FIG. 4 shows another potential embodiment.

FIG. 4 shows an alternative compressor discharge system 400. Here, a pulsation dampener 402 actually incorporates two of the stages as shown in the earlier embodiment. The inlet 404 is circumferentially aligned with the outlet 406. The outlet 406 is shown communicating with an inlet for a single stage pulsation dampener 408 having an outlet 410 spaced by 180°. The "double" unit, such as unit 402, allows reaching multiple pulsation dampener stages with a fewer number of connections.

A method of assembling a compressor system comprising attaching at least two pulsation damper stages to a discharge port on a compressor, and attaching additional pulsation dampening stages if additional stages are desired. The damper stages may be as shown in FIGS. 2A-2F.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A method of assembling a compressor system comprising the steps of:

attaching at least two pulsation damper stages mounted in series with an upstream one of said pulsation damper stages having an inlet connected to a discharge port on a compressor;

each of said pulsation damper stages being identical and having an inlet spaced from an outlet by 180 degrees about a center line of each of said pulsation damper stages;

attaching a muffler and an oil separator downstream of the downstream one of said pulsation damper stages;

including the step of mounting a component discharge having a check valve downstream of said downstream one of said pulsation damper stages; and wherein said pulsation damper stages including a plurality of cells extending into a housing member, and having a bottom wall and a perforated plate communicating with a flow passage, with a plurality of orifices extending into each of said cells through said perforated plate, with said orifices having a smaller diameter than a hydraulic diameter of said cells.

2. The method as set forth in claim 1, wherein said compressor is a screw compressor.

3. The method as set forth in claim 1, wherein an average depth into said cells measured between an inner face of said perforated plate and said bottom wall of said cell is defined as a first distance, and a second distance is defined as an average hydraulic diameter of said cells and a ratio of said first distance to said second distance is between 0.025 and 25.

4. The method as set forth in claim 3, wherein a diameter of said orifices is defined as a third distance and a ratio of said first distance to said third distance is between 0.5 and 500.

5. A method of assembling a compressor system comprising the steps of:

attaching at least two pulsation damper stages mounted in series with an upstream one of said pulsation damper stages having an inlet connected to a discharge port on a compressor; and wherein each said pulsation damper stages including a plurality of cells extending into a housing member, and having a bottom wall and a perforated plate communicating with a flow passage, with a plurality of orifices extending into each of said cells through said perforated plate, with said orifices having a smaller diameter than a hydraulic diameter of said cells.

6. The method as set forth in claim 5, wherein at least two of said at least two pulsation dampener stages is provided in a dual stage pulsation damper having an inlet and an outlet that are circumferentially aligned.

7. The method as set forth in claim 5, wherein an average depth into said cells measured between an inner face of said perforated plate and said bottom wall of said cell is defined as a first distance, and a second distance is defined as an average hydraulic diameter of said cells and a ratio of said first distance to said second distance is between 0.025 and 25.

8. The method as set forth in claim 7, wherein a diameter of said orifices is defined as a third distance and a ratio of said first distance to said third distance is between 0.5 and 500.

* * * * *